US008247993B2

(12) United States Patent
Gong et al.

(10) Patent No.: US 8,247,993 B2
(45) Date of Patent: Aug. 21, 2012

(54) APPARATUS FOR DRIVING MULTI-LIGHT EMITTING DEVICES

(75) Inventors: Jung Chul Gong, Seoul (KR); Byoung Own Min, Gyunggi-do (KR); Bon Ahm Goo, Seoul (KR); Sang Cheol Shin, Gyunggi-do (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 309 days.

(21) Appl. No.: 12/560,915

(22) Filed: Sep. 16, 2009

(65) Prior Publication Data

US 2010/0109563 A1 May 6, 2010

(30) Foreign Application Priority Data

Oct. 30, 2008 (KR) ..... 10-2008-0107249

(51) Int. Cl.
*H05B 37/02* (2006.01)

(52) U.S. Cl. ..... 315/294; 315/297

(58) Field of Classification Search ..... 315/294, 315/185 R, 307, 308, 297
See application file for complete search history.

(56) References Cited

U.S. PATENT DOCUMENTS 6,864,641 B2 3/2005 Dygert
7,936,090 B2 * 5/2011 Chien et al. ..... 307/31
2007/0296353 A1 12/2007 Ito et al.

FOREIGN PATENT DOCUMENTS

CN 101057344 10/2007

OTHER PUBLICATIONS

Chinese Office Action for Application No. 200910176283.4 mailed Mar. 28, 2012.

* cited by examiner

*Primary Examiner* — Daniel D Chang
(74) *Attorney, Agent, or Firm* — Lowe, Hauptman, Ham & Berner, LLP

(57) ABSTRACT

An apparatus for driving multi-light emitting devices that drives a multi-channel light emitting unit having a plurality of light emitting channels connected in parallel with each other, each of which has a plurality of light emitting devices connected in series with each other according to an aspect of the invention may include: a DC/DC converter generating a driving voltage; a current control unit having a plurality of current sources connected between cathodes of the plurality of light emitting channels and a ground; a minimum voltage selection unit detecting a minimum detection voltage among the plurality of detected voltages at the cathodes of the plurality of light emitting channels; a first error detection unit detecting an error voltage determined by the difference between the minimum detection voltage and a predetermined first reference voltage; and a feedback coupling unit supplying the input voltage according to the error voltage and the driving voltage.

4 Claims, 4 Drawing Sheets

APPARATUS FOR DRIVING MULTI-LIGHT EMITTING DEVICES

CROSS-REFERENCE TO RELATED APPLICATIONS

This application claims the priority of Korean Patent Application No. 10-2008-0107249 filed on Oct. 30, 2008, in the Korean Intellectual Property Office, the disclosure of which is incorporated herein by reference.

BACKGROUND OF THE INVENTION

1. Field of the Invention

The present invention relates to apparatuses for driving multi-light emitting devices that can be used in lighting apparatuses or backlight units, and more particularly, to an apparatus for driving multi-light emitting devices that can be manufactured in a simple manner at low cost using a single DC/DC converter in a system using light emitting devices in multi-channels, where a minimum value can be selected among feedback values of the channels.

2. Description of the Related Art

In general, light emitting diodes (LEDs) have been applied to various objects in many fields, such as lighting apparatuses and backlight units, and will also be applied to more various fields in the future. Methods of driving LEDs include a method using switch-mode DC/DC converters and a method using linear current sources.

In the related art, an apparatus for driving LEDs using a current source includes a DC/DC converter that supplies driving power to LEDs and a current source that controls the currents flowing through the LEDs being driven by the driving power.

However, in the apparatus for driving LEDs according to the related art, LEDs may be open. When a detection circuit detecting whether LEDs are open is added, a control unit needs to be added to control the driving operation according to a detection signal supplied by the detection circuit. Furthermore, the configuration of the driving apparatus becomes complicated, that is, additional software or hardware configuration needs to be implemented such that the control unit performs a control operation according to a detection signal. This causes an increase in manufacturing costs, thereby reducing the competitiveness of the final product.

SUMMARY OF THE INVENTION

An aspect of the present invention provides an apparatus for driving multi-light emitting devices that can be manufactured in a simple manner at low cost using a single DC/DC converter.

According to an aspect of the present invention, there is provided an apparatus for driving multi-light emitting devices that drives a multi-channel light emitting unit having a plurality of light emitting channels connected in parallel with each other, each of which has a plurality of light emitting devices connected in series with each other, the apparatus including: a DC/DC converter generating a driving voltage on the basis of an input voltage and supplying the generated driving voltage to an anode of the multi-channel light emitting unit; a current control unit having a plurality of current sources connected between cathodes of the plurality of light emitting channels and a ground, and maintaining the consistency of the currents flowing through the plurality of light emitting channels; a minimum voltage selection unit detecting voltages at the cathodes of the plurality of light emitting channels and detecting a minimum detection voltage among the plurality of detected voltages; a first error detection unit detecting an error voltage corresponding to a difference voltage determined by the difference between the minimum detection voltage of the minimum voltage selection unit and a predetermined first reference voltage; and a feedback coupling unit coupling the output of the first error detection unit and the input of the DC/DC converter and supplying the input voltage according to the error voltage from the first error detection unit and the driving voltage of the DC/DC converter.

The plurality of light emitting devices of the multi-channel light emitting unit may be light emitting diodes.

The first error detection unit may include a first comparator having a non-inverting input terminal receiving the minimum detection voltage of the minimum voltage selection unit, an inverting input terminal receiving the first reference voltage, and an output terminal outputting the error voltage corresponding to a difference voltage determined by the difference between the minimum detection voltage and the first reference voltage.

The feedback coupling unit may include: a first MOS transistor having a drain connected to an operating power supply terminal, a gate connected to the output terminal of the first error detection unit, and a source connected to an input node of the DC/DC converter; a first resistor connected between an output terminal of the DC/DC converter and the input node of the DC/DC converter; a second resistor connected between the input node and a ground; and a third resistor connected between the source of the first MOS transistor and the ground.

The minimum voltage selection unit may include a first minimum voltage selector selecting a minimum detection voltage among the plurality of detection voltages.

The minimum voltage selection unit may include: a first minimum voltage selector selecting a first minimum voltage among some of the plurality of detection voltages; and a second minimum voltage selector selecting a minimum detection voltage among the rest of the plurality of detection voltages and the first minimum voltage from the first minimum voltage selector.

The minimum voltage selection unit may include first to n-th minimum voltage selectors each selecting a minimum voltage among detection voltages in each of a plurality of first to n-th groups into which a plurality of detection voltage terminals corresponding to the plurality of light emitting channels are divided, each group including a predetermined number of detection voltage terminals, the first minimum voltage selector may select a first minimum voltage among a plurality of detection voltages of the first group, the second minimum voltage selector may select a second minimum voltage corresponding to a minimum voltage among a plurality of detection voltages of the second group and the first minimum voltage from the first minimum voltage selector, and the n-th minimum voltage selector may select a minimum detection voltage among the plurality of detection voltages of the n-th group and an n-1-th minimum voltage being input.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
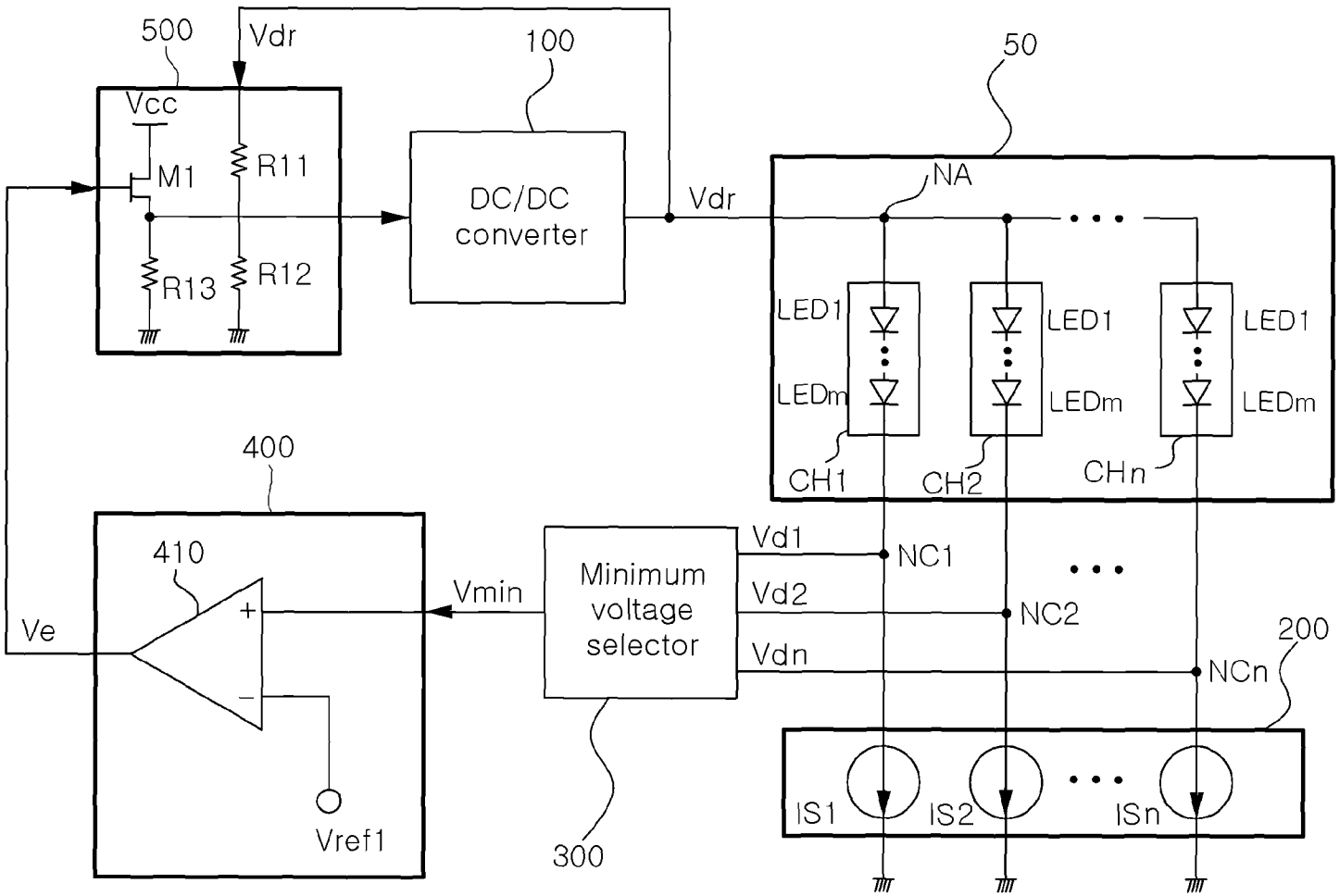
FIG. 1 is a block diagram illustrating an apparatus for driving multi-light emitting devices according to an exemplary embodiment of the invention.

Exemplary embodiments of the present invention will now be described in detail with reference to the accompanying drawings. The invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the same reference numerals will be used throughout to designate the same or like components.

FIG. 1 is a block diagram illustrating an apparatus for driving multi-light emitting devices according to an exemplary embodiment of the invention.

Referring to FIG. 1, an apparatus for driving multi-light emitting devices according to this embodiment drives a multi-channel light emitting unit 50. The multi-channel light emitting unit 50 includes a plurality of light emitting channels CH1 to CHn that are connected in parallel with each other, and each of the plurality of light emitting channels CH1 to CHn includes a plurality of light emitting devices LED 1 to LEDm that are connected in series with each other. The apparatus for driving a multi-light emitting device includes a DC/DC converter 100, a current control unit 200, a minimum voltage selection unit 300, a first error detection unit 400 and a feedback coupling unit 500. The DC/DC converter 100 generates a driving voltage Vdr on the basis of the input voltage and supplies the generated driving voltage Vdr to an anode of the multi-channel light emitting unit 50. The current control unit 200 includes a plurality of current sources IS1 to ISn that are connected between a ground and cathodes of the plurality of light emitting channels CH1 to CHn, respectively, to maintain the consistency of the currents flowing through the plurality of light emitting channels CH1 to CHn. The minimum voltage selection unit 300 detects voltages at the cathodes of the plurality of light emitting channels CH1 to CHn to obtain a plurality of detection voltages Vd1 to Vdn, and then selects a minimum detection voltage Vmin among the detection voltages Vd1 to Vdn. The first error detection unit 400 detects an error voltage Ve corresponding to a difference voltage determined by the difference between the minimum detection voltage Vmin of the minimum voltage selection unit 300 and a predetermined first reference voltage Vref1. The feedback coupling unit 500 couples the output of the first error detection unit 400 and the input of the DC/DC converter 100 to supply the input voltage according to the error voltage Ve from the first error detection unit 400 and the driving voltage Vdr of the DC/DC converter 100.

In the multi-channel light emitting unit 50 according to this embodiment, the plurality of light emitting devices LED1 to LEDm may be light emitting diodes (LEDs).

Here, the first error detection unit 400 may include a first comparator 410. The first comparator 410 includes a non-inverting input terminal that receives the minimum detection voltage Vmin of the minimum voltage selection unit 300, an inverting input terminal receiving the first reference voltage Vref1, and an output terminal outputting the error voltage Ve corresponding to a difference voltage determined by the difference between the minimum detection voltage Vmin and the first reference voltage Vref1.

The feedback coupling unit 500 includes a first MOS transistor M1, a first resistor R11, a second resistor R12 and a third resistor R13. The first MOS transistor M1 has a drain connected an operating power supply Vcc terminal, a gate connected to the output terminal of the first error detection unit 400, and a source connected to an input node NI of the DC/DC converter 100. The first resistor R11 is connected between an output terminal of the DC/DC converter 100 and the input node NI of the DC/DC converter 100. The second resistor R12 is connected between the input node NI and the ground, and the third resistor R13 is connected between the source of the first MOS transistor M1 and a ground.

The minimum voltage selection unit 300 according to this embodiment may include a first minimum voltage selector 300-1 that selects the minimum detection voltage Vmin among the plurality of detection voltages Vd1 to Vdn. This will be described with reference to FIG. 2.

Figure 2:
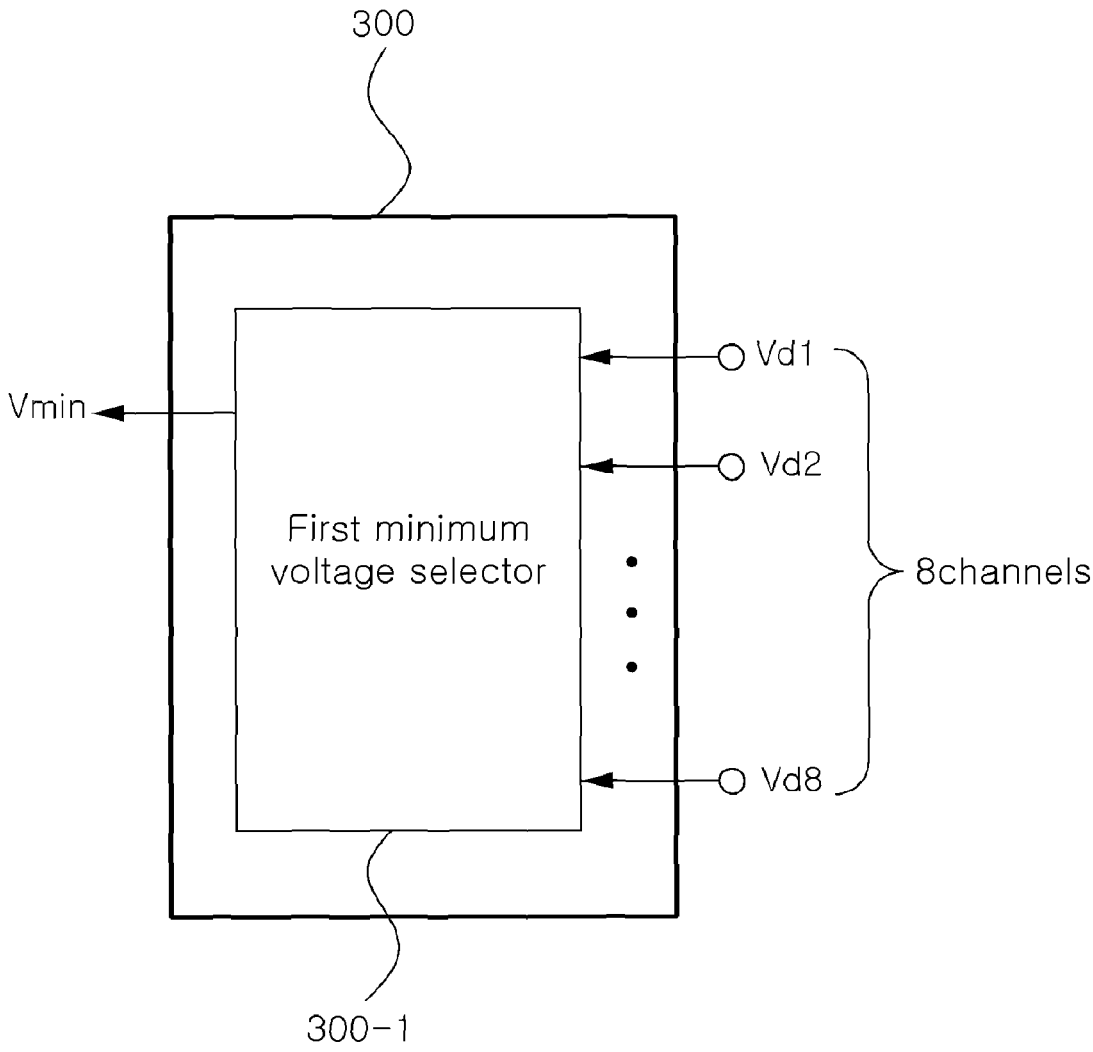
FIG. 2 is a view illustrating a first example of a minimum voltage selection unit according to an exemplary embodiment of the invention.

FIG. 2 is a view illustrating a first example of a minimum voltage selection unit according to an exemplary embodiment of the invention.

Referring to FIG. 2, when the plurality of detection voltages Vd1 to Vdn are first to eighth detection voltages Vd1 to Vd8, the minimum voltage selection unit 300 may select the minimum detection voltage Vmin among the first to eighth detection voltages Vd1 to Vd8.

The minimum voltage selection unit 300 may include a first minimum voltage selector 300-1 and a second minimum voltage selector 300-2. The first minimum voltage selector 300-1 selects a first minimum voltage Vs1 among detection voltages V1 to Vdk of the plurality of detection voltages Vd1 to Vdn. The second minimum voltage selector 300-2 selects the minimum detection voltage Vmin among detection voltages Vd[k+1] to Vn of the plurality of detection voltages Vd1 to Vdn and the first minimum voltage Vs1 from the first minimum voltage selector 300-1. This will be described with reference to FIG. 3.

Figure 3:
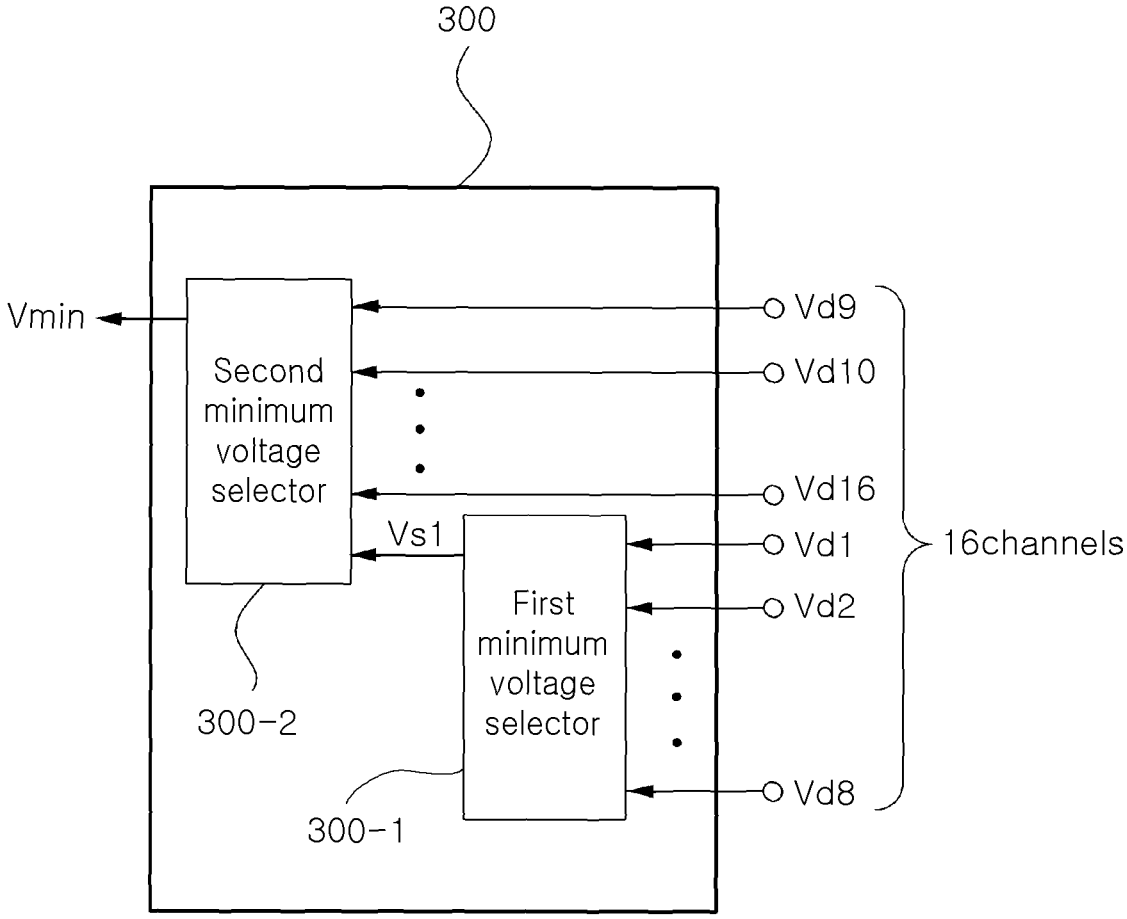
FIG. 3 is a view illustrating a second example of a minimum voltage selection unit according to an exemplary embodiment of the invention.

FIG. 3 is a view illustrating a second example of a minimum voltage selection unit according to an exemplary embodiment of the invention.

Referring to FIG. 3, when the detection voltages Vd1 to Vdk are first to eighth detection voltages Vd1 to Vd8, respectively, and the detection voltages Vd[k+1] to Vn are ninth to sixteenth detection voltages Vd9 to Vd16, the first minimum voltage selector 300-1 selects the first minimum voltage Vs1 among the detection voltages Vd1 to Vd8. Then, the second minimum voltage selector 300-2 selects the minimum detection voltage Vmin among the detection voltages Vd9 to V18 and the first minimum voltage Vs1 of the first minimum voltage selector 300-1.

Figure 4:
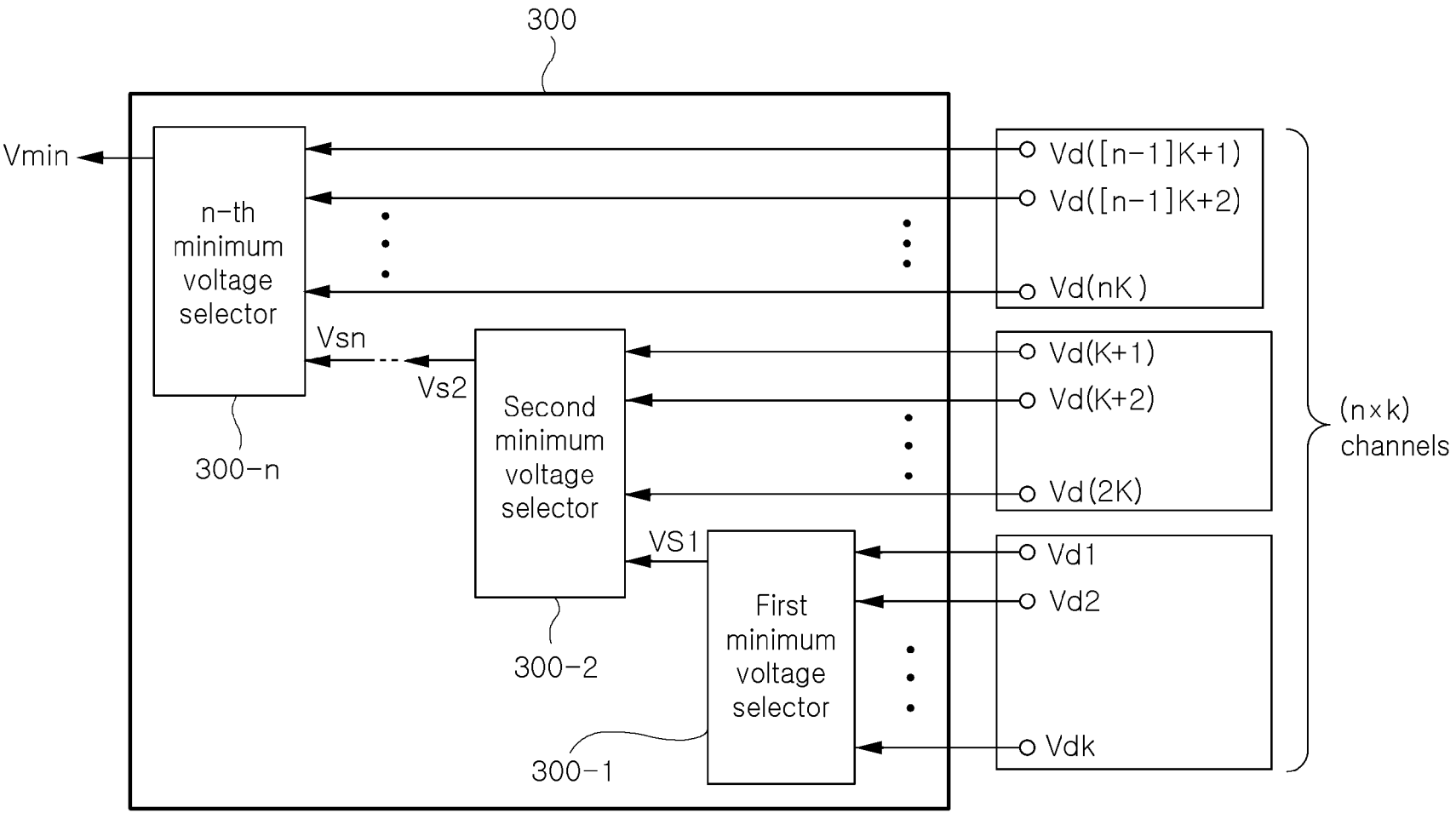
FIG. 4 is a view illustrating a third example of a minimum voltage selection unit according to an exemplary embodiment of the invention.

FIG. 4 is a view illustrating a third example of a minimum voltage selection unit according to an exemplary embodiment of the invention.

Referring to FIG. 4, the minimum voltage selection unit 300 includes the first to n-th minimum voltage selectors 300-1 to **300-*n*, each of which selects a minimum voltage among detection voltages in each of the first to n-th groups into which a plurality of detection voltage terminals corresponding to the plurality of light emitting channels CH1** to CHn are divided, each group including a predetermined number of detection voltage terminals.

Here, the first minimum voltage selector 300-1 selects the first minimum voltage Vs1 among the plurality of detection voltages Vd1 to Vd[k] in the first group. The second minimum voltage selector 300-2 selects the second minimum voltage Vs2 corresponding to a minimum voltage among a plurality of detection voltages Vd[k+1] to Vd[2*k*] in the second group and the first minimum voltage Vs1 from the first minimum voltage selector 310. The n-th minimum voltage selector 300-*n* selects the minimum detection voltage Vmin among a plurality of Vd[(n−1)k+1] to Vd[nk] in the n-th group and an n-1-th minimum voltage Vs[n-1] in the n-th group being input.

Hereinafter, the operation and effect of the invention will be described in detail with the accompanying drawings.

The apparatus for driving multi-light emitting devices according to this embodiment is now described with reference to FIGS. 1 to 4. In order to efficiently drive the multi-channel light emitting unit 50, which includes the plurality of light emitting channels CH1 to CHn connected in parallel with each other, each including the plurality of light emitting devices LED1 to LEDm connected in series with each other, the apparatus for driving a multi-light emitting device, shown in FIG. 1, may include the DC/DC converter 100, the current control unit 200, the minimum voltage selection unit 300, the first error detection unit 400 and the feedback coupling unit 500.

The DC/DC converter 100 generates the driving voltage Vdr on the basis of the input voltage and supplies the generated driving voltage Vdr to the anode of the multi-channel light emitting unit 50. Then, the driving voltage Vdr causes a driving current to flow through each of the plurality of light emitting channels CH1 to CHn of the multi-channel light emitting unit 50.

Here, the plurality of current sources IS1 to Isn of the current control unit 200 control current levels to maintain the consistency of the currents flowing through the plurality of light emitting channels CH1 to CHn, respectively.

While the driving currents flow through the plurality of light emitting channels CH1 to CHn of the multi-channel light emitting unit 50, the minimum voltage selection unit 300 detects a plurality of detection voltages at the cathodes of the plurality of light emitting channels CH1 to CHn to obtain the plurality of detection voltages Vd1 to Vdn, and then selects the minimum detection voltage Vmin among the plurality of detection voltages Vd1 to Vdn for monitoring to assure stable driving.

Then, the first error detection unit 400 detects the error voltage Ve corresponding to the difference voltage determined by the difference between the minimum detection voltage Vmin of the minimum voltage selection unit 20 and the predetermined first reference voltage Vref1.

More specifically, like the internal circuit, shown in FIG. 1, the first error detection unit 400 may include the first comparator 410. Here, the first comparator 410 outputs to the feedback coupling unit 500 through the output terminal, the error voltage Ve corresponding to the difference voltage determined by the difference between the minimum detection voltage Vmin of the minimum voltage selection unit 300, which is input through the non-inverting input terminal, and the first reference voltage Vref1, which is input through the inverting input terminal.

The feedback coupling unit 500 supplies the input voltage to the DC/DC converter 100 according to the error voltage Ve from the first error detection unit 400 and the driving voltage Vdr from the DC/DC converter 100.

Specifically, like the internal circuit, shown in FIG. 1, the feedback coupling unit 500 may include an emitter follower, including the first MOS transistor M1. Here, in the normal state, the error voltage Ve has a higher level than a turn-on voltage so that the first MOS transistor M1 is turned on. On the other hand, in an abnormal state, the error voltage Ve has a lower level than the turn-on voltage of the first error detection unit 400 so that the first MOS transistor M1 is turned off.

In the normal state in which the first MOS transistor M1 is turned on, when the DC/DC converter 100 has the input voltage of 2.5V, and the first resistor R11 and the second resistor R12 have the same resistance, a voltage of 2.5V is applied across the input node NI corresponding to an intermediate node between the first resistor R11 and the second resistor R12, and thus the DC/DC converter 100 outputs the driving voltage Vdr of 5V. Therefore, when a voltage of 2.5V is applied through the first MOS transistor Ml, the voltage of 2.5V is applied to either terminal of the third resistor R13, and the voltage of 2.5V is applied as the DC/DC voltage.

On the other hand, in an abnormal state in which the first MOS transistor M1 is turned off, as described above, when the DC/DC converter 100 has the input voltage of 2.5V, and the first resistor R11 and the second resistor R12 have the same resistance, the feedback coupling unit 500 operates so that voltage across the input node NI becomes 2.5V due to parallel resistors (R12//R13) including the second resistor R12 and the third resistor R13, and the first resistor R11. As a result, the driving voltage relatively increases to approximately 7.5V.

Even when the multi-channel light emitting unit 50 is open, since the voltage across the parallel resistors including the second resistor R12 and the third resistor R13 is applied to the DC/DC converter 100, the driving voltage Vdr of the DC/DC converter 100 can increase to the maximum voltage. As a result, the DC/DC converter 100 and the multi-channel light emitting unit 50 can be protected.

The minimum voltage selection unit 300 according to this embodiment selects the minimum detection voltage Vmin among the plurality of detection voltages Vd1 to Vdn that are detected at the cathodes of the plurality of light emitting channels CH1 to CHn, respectively, of the multi-channel light emitting unit 50.

Specifically, the number of light emitting channels included in the multi-channel light emitting unit 50 varies according to the size (inches) of the LCD being used. For example, in the case of a 40-inch LCD, there are 64 channels, and in the case of a 55-inch LCD, there are 96 channels.

As shown in FIG. 2, when the minimum voltage selection unit 300 can receive the plurality of detection voltages Vd1 to Vdn at the same time, the minimum voltage selection unit 300 may include one first minimum voltage selector 300-1. Here, when the multi-channel light emitting unit 50 includes first to eighth light emitting channels CH1 to CH8, the first minimum voltage selector 300-1 may select the minimum detection voltage Vmin among first to eighth detection voltages Vd1 to Vd8.

On the other hand, when the minimum voltage selection unit 300 cannot receive the plurality of detection voltages Vd1 to Vdn at the same time, as shown in FIG. 3 or 4, the minimum voltage selection unit 300 may include a plurality of minimum voltage selectors.

For example, the minimum voltage selection unit 300 may include the first minimum voltage selector 300-1 and the second minimum voltage selector 300-2. This will be described with reference to FIG. 3.

Referring to FIG. 3, the first minimum voltage selector 300-1 selects the first minimum voltage Vs1 among the detection voltages Vd1 to Vd8. Then, the second minimum voltage selector 300-2 selects the minimum detection voltage Vmin among the detection voltages Vd9 to V18 and the first minimum voltage Vs1 from the first minimum voltage selector 300-1.

In another example in which the number of channels selected by the minimum voltage selection unit 300 is increased, the minimum voltage selection unit 300 may include the first to n-th minimum voltage selectors 300-1 to **300-*n*. This will be described with reference to FIG. 4**.

Referring to FIG. 4, the multi-channel light emitting unit 50 includes the plurality of light emitting channels CH1 to CHn that are connected in parallel with each other. Each of the plurality of light emitting channels CH1 to CHn includes the plurality of light emitting devices LED1 to LEDm that are connected in series with each other. Further, in the multi-channel light emitting unit 50, a plurality of detection voltage terminals corresponding to the plurality of light emitting channels CH1 to CHn are divided into the plurality of first to n-th groups, each group including a predetermined number of detection voltage terminals.

Here, the minimum voltage selection unit 300 according to this embodiment may include first to n-th minimum voltage selectors each of which selects a minimum voltage of each of the first to n-th groups. Here, the first minimum voltage selector 300-1 may select the first minimum voltage Vs1 among the plurality of detection voltages Vd1 to Vd[k] of the first group. The second minimum voltage selector 300-2 may select the second minimum voltage Vs2 corresponding to a minimum voltage among the plurality of detection voltages Vd[k+1] to Vd[2*k*] of the second group and the first minimum voltage Vs1 from the first minimum voltage selector 310. The n-th minimum voltage selector **300-*n* may select the minimum detection voltage Vmin among a plurality of detection voltages Vd[(n−1)k+1] to Vd[nk] of the n-th group and the n-1**-th minimum voltage Vs[n−1] being input.

For example, in FIG. 4, when the first to n-th minimum voltage selectors 300-1 to **300-*n* have eight input terminals and one feedback terminal and consist of first to third minimum voltage selectors, the first minimum voltage selector 300-1 may select the first minimum voltage Vs1 among the eight detection voltages Vd1 to Vd8 of the first group, the second minimum voltage selector 300-2 may select the second minimum voltage Vs2 corresponding to a minimum voltage among eight detection voltages Vd9 to Vd16 of the second group and the first minimum voltage Vs1 from the first minimum voltage selector 310, and the third minimum voltage selector may select the minimum detection voltage Vmin among the eight detection voltages Vd17 to Vd24 and the second minimum voltage Vs2** being input.

As described above, voltage of each of the plurality of light emitting channels CH1 to CHn of the multi-channel light emitting unit 50 can be detected, the plurality of light emitting channels CH1 to CHn of the multi-channel light emitting unit 50 can be driven using a single DC/DC converter, and feedback control thereof can be realized.

As set forth above, according to exemplary embodiments of the invention, an apparatus for driving multi-light emitting devices can be manufactured in a simple manner at low cost using a single DC/DC converter in a system using light emitting devices in multi-channels, where a minimum value can be selected among feedback values of the channels.

While the present invention has been shown and described in connection with the exemplary embodiments, it will be apparent to those skilled in the art that modifications and variations can be made without departing from the spirit and scope of the invention as defined by the appended claims.

What is claimed is:

1. An apparatus for driving a multi-channel light emitting unit including a plurality of light emitting channels connected in parallel with each other, each of the light emitting channels including a plurality of light emitting devices connected in series with each other, the apparatus comprising:

a DC/DC converter configured to generate a driving voltage based on an input voltage and supply the driving voltage to an anode of the multi-channel light emitting unit;

a current control unit including a plurality of current sources connected between cathodes of the light emitting channels and a ground, and configured to keep currents flowing through the light emitting channels constant;

a minimum voltage selection unit configured to detect voltages at the cathodes of the light emitting channels and detect a minimum detection voltage among the detected voltages;

a first error detection unit configured to detect an error voltage corresponding to a difference between the minimum detection voltage and a predetermined first reference voltage; and a feedback coupling unit configured to couple an output of the first error detection unit and an input of the DC/DC converter and supply the input voltage according to the error voltage and the driving voltage of the DC/DC converter, wherein the light emitting devices are light emitting diodes, and the first error detection unit comprises a first comparator having a non-inverting input terminal for receiving the minimum detection voltage, an inverting input terminal for receiving the first reference voltage, and an output terminal for outputting the error voltage.

2. An apparatus for driving a multi-channel light emitting unit including a plurality of light emitting channels connected in parallel with each other, each of the light emitting channels including a plurality of light emitting devices connected in series with each other, the apparatus comprising:

a DC/DC converter configured to generate a driving voltage based on an input voltage and supply the driving voltage to an anode of the multi-channel light emitting unit;

a current control unit including a plurality of current sources connected between cathodes of the light emitting channels and a ground, and configured to keep currents flowing through the light emitting channels constant;

a minimum voltage selection unit configured to detect voltages at the cathodes of the light emitting channels and detect a minimum detection voltage among the detected voltages;

a first error detection unit configured to detect an error voltage corresponding to a difference between the minimum detection voltage and a predetermined first reference voltage; and a feedback coupling unit configured to couple an output of the first error detection unit and an input of the DC/DC converter and supply the input voltage according to the error voltage and the driving voltage of the DC/DC converter, wherein the light emitting devices are light emitting diodes, and the feedback coupling unit comprises:

a first MOS transistor having a drain connected to an operating power supply terminal, a gate connected to the output of the first error detection unit, and a source connected to the input of the DC/DC converter;

a first resistor connected between an output of the DC/DC converter and the input of the DC/DC converter;

a second resistor connected between the input of the DC/DC converter and a ground; and a third resistor connected between the source of the first MOS transistor and the ground.

3. An apparatus for driving a multi-channel light emitting unit including a plurality of light emitting channels connected in parallel with each other, each of the light emitting channels including a plurality of light emitting devices connected in series with each other, the apparatus comprising:

a DC/DC converter configured to generate a driving voltage based on an input voltage and supply the driving voltage to an anode of the multi-channel light emitting unit;

a current control unit including a plurality of current sources connected between cathodes of the light emitting channels and a ground, and configured to keep currents flowing through the light emitting channels constant;

a minimum voltage selection unit configured to detect voltages at the cathodes of the light emitting channels and detect a minimum detection voltage among the detected voltages;

a first error detection unit configured to detect an error voltage corresponding to a difference between the minimum detection voltage and a predetermined first reference voltage; and a feedback coupling unit configured to couple an output of the first error detection unit and an input of the DC/DC converter and supply the input voltage according to the error voltage and the driving voltage of the DC/DC converter, wherein the minimum voltage selection unit comprises:

a first minimum voltage selector configured to select a first minimum voltage among some of the detected voltages; and a second minimum voltage selector configured to select the minimum detection voltage among the rest of the detected voltages and the first minimum voltage from the first minimum voltage selector.

4. An apparatus for driving a multi-channel light emitting unit including a plurality of light emitting channels connected in parallel with each other, each of the light emitting channels including a plurality of light emitting devices connected in series with each other, the apparatus comprising:

a DC/DC converter configured to generate a driving voltage based on an input voltage and supply the driving voltage to an anode of the multi-channel light emitting unit;

a current control unit including a plurality of current sources connected between cathodes of the light emitting channels and a ground, and configured to keep currents flowing through the light emitting channels constant;

a minimum voltage selection unit configured to detect voltages at the cathodes of the light emitting channels and detect a minimum detection voltage among the detected voltages;

a first error detection unit configured to detect an error voltage corresponding to a difference between the minimum detection voltage and a predetermined first reference voltage; and a feedback coupling unit configured to couple an output of the first error detection unit and an input of the DC/DC converter and supply the input voltage according to the error voltage and the driving voltage of the DC/DC converter, wherein the minimum voltage selection unit comprises first to n-th minimum voltage selectors each for selecting a minimum voltage among the detected voltages in each of first to n-th groups into which a plurality of detection voltage terminals corresponding to the light emitting channels are divided, each group including a predetermined number of detection voltage terminals, the first minimum voltage selector is configured to select a first minimum voltage among the detected voltages of the first group, the second minimum voltage selector is configured to select a second minimum voltage among the detected voltages of the second group and the first minimum voltage from the first minimum voltage selector, and the n-th minimum voltage selector is configured to select the minimum detection voltage among the detected voltages of the $n^{th}$ group and an $(n-1)^{th}$ minimum voltage from the $(n-1)^{th}$ minimum voltage selector.

* * * * *